US011641925B2

(12) United States Patent
Trochel

(10) Patent No.: US 11,641,925 B2
(45) Date of Patent: May 9, 2023

(54) REFILLABLE ASSEMBLY FOR DISPENSING COSMETIC PRODUCT

(71) Applicant: AXILONE PLASTIQUE, Auray (FR)

(72) Inventor: Reynaid Trochel, Plouharnel (FR)

(73) Assignee: AXILONE PLASTIQUE, Auray (FR)

( * ) Notice: Subject to any disclaimer, the term of this patent is extended or adjusted under 35 U.S.C. 154(b) by 21 days.

(21) Appl. No.: 17/386,184

(22) Filed: Jul. 27, 2021

(65) Prior Publication Data

US 2022/0031045 A1 Feb. 3, 2022

(30) Foreign Application Priority Data

Jul. 29, 2020 (FR) ..... 2007998

(51) Int. Cl.
*A45D 40/12* (2006.01)
*A45D 40/06* (2006.01)
*A45D 40/00* (2006.01)

(52) U.S. Cl.
CPC ..... *A45D 40/12* (2013.01); *A45D 40/06* (2013.01); *A45D 2040/0025* (2013.01); *A45D 2040/0031* (2013.01); *A45D 2040/0062* (2013.01)

(58) Field of Classification Search
CPC ..... A45D 40/12; A45D 40/06; A45D 40/00; A45D 40/04; A45D 40/18; A45D 2040/0062; A45D 2040/0025; A45D 2040/0031; A45D 2040/0037; A45D 2040/0043; A45D 2040/005; A45D 2040/0056
USPC ..... 401/75–78
See application file for complete search history.

(56) References Cited

U.S. PATENT DOCUMENTS 9,433,276 B2 * 9/2016 McNamara ..... A45D 40/06
11,395,535 B2 * 7/2022 Dunton ..... A45D 40/16

FOREIGN PATENT DOCUMENTS

FR 3 066 081 11/2018
WO 2019/115924 6/2019
WO WO-2019115924 A1 * 6/2019 ..... A45D 40/06

OTHER PUBLICATIONS

Search Report for FR2007998, dated Mar. 15, 2021, 9 pages.

* cited by examiner

*Primary Examiner* — David J Walczak
(74) *Attorney, Agent, or Firm* — Nixon & Vanderhye

(57) ABSTRACT

A refillable assembly for dispensing cosmetic product, including a base and a cartridge selectively connectable with the base. The base includes a cartridge receiving element and a cartridge locking element. The locking element is movable relative to the receiving element at least in rotation about the longitudinal axis in a first direction towards an open position and in a second direction towards a closed position. In the open position, the cartridge is movable relative to the base along the longitudinal axis; in the closed position when the cartridge is inserted into the base the cartridge is integral with the base along the longitudinal axis.

20 Claims, 11 Drawing Sheets

REFILLABLE ASSEMBLY FOR DISPENSING COSMETIC PRODUCT

This application claims priority to FR Patent Application No. 2007998 filed 29 Jul. 2020, the entire contents of which is hereby incorporated by reference.

BACKGROUND OF THE INVENTION

Field of the Invention

This relates to the field of containers for cosmetic product. More specifically, this relates to devices for dispensing cosmetic product which comprise a base and a cartridge that are configured to be removably coupled to each other. This relates in particular to lipstick dispensing devices.

Description of the Related Art

A device for dispensing cosmetic product may include a base and a cartridge coupled to the base. This is the case in particular for lipstick dispensing devices. The cartridge contains a stick of lipstick and the base allows gripping the lipstick dispensing device.

The cartridge and the base are aligned along a longitudinal axis of the dispensing device. When mated, the base can be rotated relative to the cartridge in order to dispense lipstick. Thus, by imparting a rotation of the base relative to the cartridge via a cartridge control socket, it is possible to move the receptacle for the stick of lipstick (also called the cup) along the longitudinal axis of the dispensing device.

Usually, the base and the cartridge are permanently coupled. Because of this, when the stick of lipstick is consumed it is necessary to purchase an entire new dispensing device.

To overcome the aforementioned disadvantage, dispensing devices have therefore been produced in which the base and the cartridge are removably coupled. Thus, when the stick of lipstick is consumed, it is possible to separate the base and the cartridge and only replace the cartridge, which is more environmentally friendly. With this system, a user can have a single base and several cartridges corresponding to lipsticks of different colors.

The connection between the cartridge and the base can be of several kinds. For example the coupling can be magnetic. The cartridge can have an element composed of a ferromagnetic material, and the base a magnet capable of cooperating with the ferromagnetic element. This type of coupling can have the disadvantage of the cartridge detaching from the base during use due to incorrect handling by the user.

Another type of connection between the cartridge and the base involves an elastic interlocking of one to the other (snap-fitting). Over time, this connection can become loose and cause an untimely disconnection of the cartridge and the base.

SUMMARY OF THE INVENTION

A refillable assembly for dispensing cosmetic product, in particular lipstick, is proposed, defining a longitudinal axis, the assembly comprising:

a base, and a cartridge selectively connectable with the base, the cartridge having an outer sheath and a control socket internal to the sheath and arranged in a lower portion of the cartridge, the control socket allowing the extraction of cosmetic product from the cartridge, the cartridge having an opening in the control socket, the base comprising:

a cartridge receiving element, the receiving element having a sleeve suitable for receiving within its interior the lower portion of the cartridge; and a cartridge locking element, the locking element being movable relative to the receiving element at least in rotation about the longitudinal axis in a first direction towards an open position and in a second direction towards a closed position; in the open position the cartridge is movable relative to the base along the longitudinal axis, in the closed position when the cartridge is inserted into the base the cartridge is integral with the base along the longitudinal axis, a connection between the locking element and the receiving element comprising a closure abutment in the closed position such that when the locking element is in the closed position and the base is rotated in the second direction, the receiving element and the locking element are integral in rotation and the control socket of the cartridge is driven by a transmission element of the base that is engageable with the control socket of the cartridge.

The refillable assembly for dispensing cosmetic product forms an intuitive, easily finger-accessible, and mechanically reliable system for locking and unlocking the cartridge.

The features set forth in the following paragraphs may optionally be implemented. They may be implemented independently of one another or in combination with one another:

the transmission element is arranged in the receiving element.

the base comprises a locking member which is engageable in the control socket of the cartridge according to the position of the locking element.

the locking member is in the locking element, the receiving element includes a bottom portion in contact with the locking element which partially closes off a lower portion of the sleeve, the bottom portion having an opening, the opening receiving the locking member.

the locking member is arranged on a bottom portion of the receiving element, the bottom portion partially closing off a lower portion of the sleeve.

the connection between the locking element and the receiving element comprises an opening abutment in the open position when the base is rotated in the first direction.

the connection between the locking element and the receiving element further comprises a closure catch at the closure abutment so as to create resistance when the locking element is in the closed position and the base is rotated in the first direction. The closure catch helps prevent unwanted rotation of the locking element in the direction opposite to the closing direction.

the connection between the locking element and the receiving element comprises a slot in one among the locking element and the receiving element, and a finger in the other among the locking element and the receiving element, the finger being engaged with and movable within the slot.

the slot has the general shape of an arc of a circle which extends in a fixed longitudinal position. The circular slot allows rotational movement similar to that performed to activate a lipstick dispensing mechanism.

the slot has the general shape of an arc of a circle which extends in a variable longitudinal position such that, when the locking element is moved relative to the receiving element in the first or second direction, the locking element follows a helical motion.

the rotation between the locking element and the receiving element occurs over an angle of less than 180 degrees, preferably less than 90 degrees, and even more preferably about 75 degrees around the longitudinal axis.

the transmission element includes a plurality of lugs arranged on the bottom portion around the locking member at an equal distance from each other, the lugs being engageable with corresponding recesses of the control socket of the cartridge.

the locking member comprises a rod extending into the opening of the cartridge through the opening of the bottom portion of the receiving element, the rod having a free end, the free end comprising a radial projection which is not symmetrical in revolution relative to the longitudinal axis, and the opening of the cartridge has a shape complementary to the projection.

the locking member comprises two flexible tabs extending along the longitudinal axis into the opening of the cartridge through the opening of the bottom portion of the receiving element, said at least two flexible tabs being in abutment against a wall of the opening of the bottom portion, and the opening of the bottom portion having a shape which is not symmetrical in revolution relative to the longitudinal axis such that the relative position of the flexible tabs with respect to the opening defines a variable distance between the flexible tabs, in the open position of the locking element the two flexible tabs being radially closer to each other than in the closed position of the locking element.

the locking member comprises a stud extending along the longitudinal axis through the opening of the bottom portion of the receiving element, the receiving element comprises a plurality of flexible tabs extending along the longitudinal axis into the opening of the cartridge, the plurality of flexible tabs being arranged around and in contact with the stud so as to define the opening through which the stud extends, a connection between the locking element and the receiving element being such that the rotation between the locking element and the receiving element causes movement of the stud along the longitudinal axis, the movement of the stud along the longitudinal axis effecting an increasing distance of the plurality of flexible tabs relative to each other between the open position and the closed position.

the projection and the opening of the cartridge each have an oval shape.

the opening of the bottom portion of the receiving element is generally oval in shape, comprising a major axis and a minor axis; in the open position each of the two flexible tabs is positioned at an end of the major axis and in the closed position each of the two flexible tabs is positioned at an end of the minor axis.

each of the two flexible tabs comprises a projection capable of engaging with a corresponding rim of the cartridge.

the plurality of flexible tabs comprises three flexible tabs and the plurality of lugs comprises three lugs.

the locking member and the transmission element are the same element.

According to another aspect, a refillable base for lipstick is provided, suitable for being associated with a removable cartridge for lipstick, the base defining a longitudinal axis, the base comprising:

a cartridge receiving element, the receiving element having a sleeve suitable for receiving within its interior a lower portion of the cartridge, the receiving element having a transmission element suitable for engaging with a control socket of the cartridge; and a locking element for locking the cartridge in the base, the locking element being movable at least in rotation with respect to the receiving element about the longitudinal axis, in a first direction towards an open position where the cartridge is detachable from the base along the longitudinal axis, and in a second direction towards a closed position where the cartridge is integral with the base along the longitudinal axis, a connection between the locking element and the receiving element comprising a closure abutment suitable for driving the control socket of the cartridge when the locking element is in the closed position and the base is rotated in the second direction.

BRIEF DESCRIPTION OF THE DRAWINGS

Other features, details, and advantages of the invention will become apparent from reading the detailed description below, and from an analysis of the accompanying drawings, in which.

DESCRIPTION OF THE PREFERRED EMBODIMENTS

The drawings and the description below for the most part contain elements that are certain in nature. Therefore not only can they serve to provide a better understanding of the invention, but they can also contribute to its definition, where appropriate.

Figure 1:
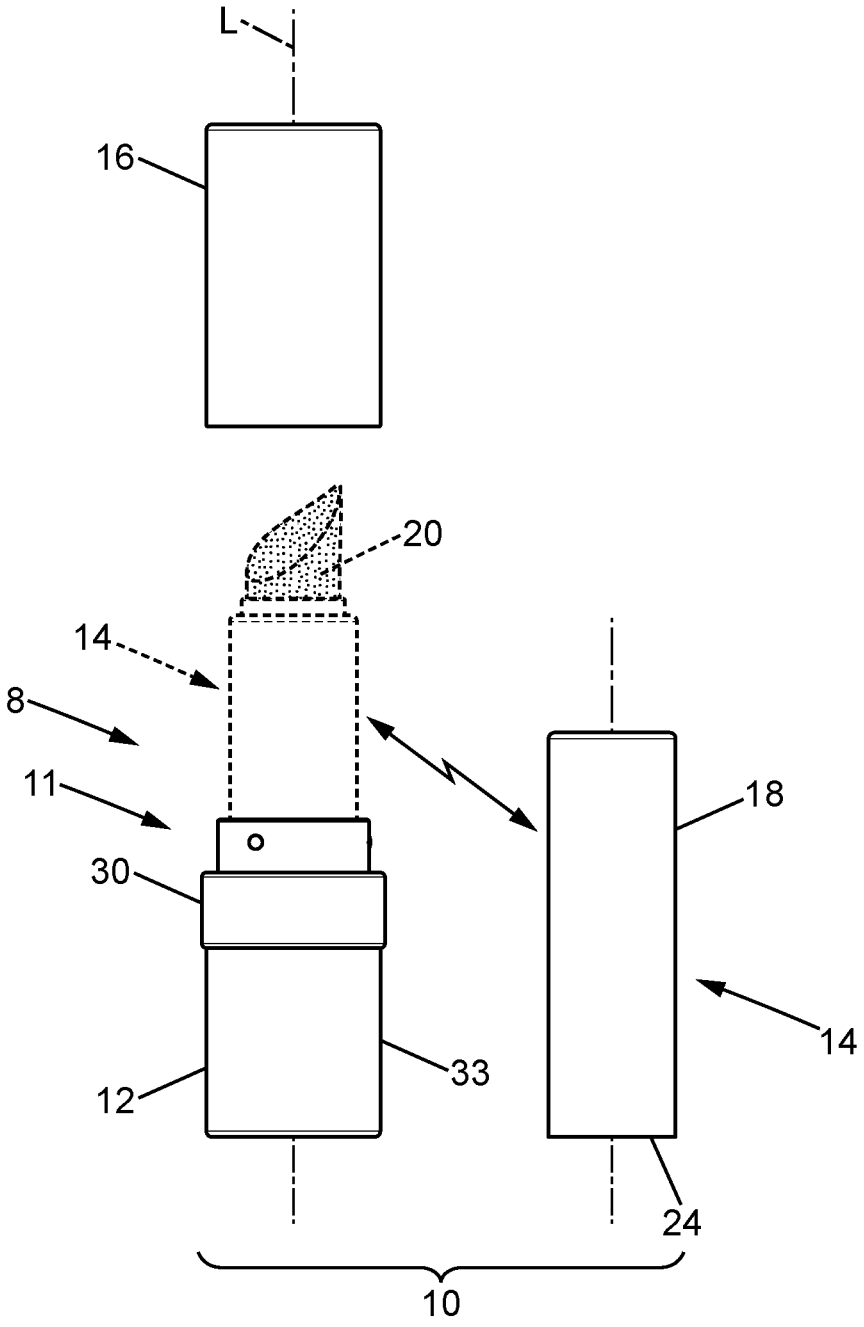
FIG. 1 shows a front view of a lipstick comprising a lipstick assembly according to one embodiment of the invention comprising a lipstick receptacle and a separate unattached removable lipstick cartridge according to one embodiment of the invention and compatible with the lipstick, the receptacle being shown with dotted lines indicating a lipstick cartridge inside it.

Referring to FIG. 1, a refillable dispenser 8 for cosmetic product, in particular for lipstick, is shown according to one embodiment. The dispenser, or lipstick 8, comprises a lipstick receptacle 11 and a separate removable cartridge 14. The receptacle 11 is an outer shell of the dispenser 8 and comprises a base 12 suitable for receiving the cartridge 14, and a cap 16 which cooperates with the base to create an outer protective shell around the cartridge 14. When the cap 16 is connected to the base 12, for example by a magnetic or mechanical device, the cartridge 14 is not accessible. To make it accessible, the cap 16 is disengaged from the base 12.

The cartridge 14 is selectively connectable to the base 12 (i.e. removable) in order to be able to reuse the base 12 when so desired (for example when the cartridge 14 is empty or another color of lipstick is desired) by inserting a replacement cartridge. The base 12 and the cap 16 are thus reusable. The refillable lipstick 8 then makes it possible to use an outer shell (i.e. receptacle 11) of superior quality, but also to reduce the consumption of packaging and therefore of plastic.

In the example of the figures, the receptacle 11 is of circular cross-section. It is possible, however, for the assembly 10 to have a different cross-section, for example square, oval, or hexagonal.

The coupling between the base 12 and the cartridge 14 can be achieved in several ways. As a non-exhaustive list, the coupling can be carried out by magnetic connection or by elastic interlocking. Preferably, the base 12 and the cartridge 14 have a coupling configured so that only the cartridges 14 of a given brand or model can engage with a predetermined base. A keying system can thus be put into place between the cartridge 14 and the base 12.

The cartridge 14 and the base 12 form an assembly 10 which, when the cartridge 14 is assembled to the base 12, defines a longitudinal axis L. The longitudinal axis L is also a longitudinal axis of the cartridge 14.

The cartridge 14 has a protective sheath 18 which, in the embodiment shown in the figures, extends over the entire height of the cartridge 14 so as to protect the internal elements of the cartridge such as a stick of lipstick 20 or a control socket (not illustrated in FIG. 1). According to one embodiment, the control socket is accessible only through the bottom of the cartridge 14, so the protective sheath 18 prevents an untimely triggering of the lipstick dispensing system. The dispensing system is a system known in the field of lipsticks where the stick of lipstick 20 is arranged in a cup, movable along the longitudinal axis L during rotation of the control socket.

The base 12 comprises a locking system (described below in various embodiments) which prevents any decoupling of the base 12 and cartridge 14. The locking system essentially comprises two elements: a receiving element which receives a lower portion of the cartridge 14, and a locking element which is rotatable relative to the receiving element. This locking system can be a second coupling between the base and the cartridge, to prevent unintentional separation of the cartridge from the base. Various locking systems will be described in relation to FIGS. 2 to 17.

By a simple rotational manipulation, similar to what the user would perform to activate the lipstick dispensing system, the user can secure the refill cartridge 14 to the base 12. Once the cartridge 14 has been inserted into the base 12, the user uses two fingers to hold a locking ring 30 integral with the receiving element of the base 12 and with the fingers of the opposite hand rotates an outer shell 33 of the base 12, the latter being integral with the base 12, until actual locking between the base 12 and the cartridge 14 is obtained. In each embodiment described below, the locking takes place while the cartridge 14 remains rotationally fixed in the base 12.

Referring to FIGS. 2 to 7, a first embodiment of a refillable assembly 100 for dispensing cosmetic product, in particular lipstick, is presented.

Figure 2:
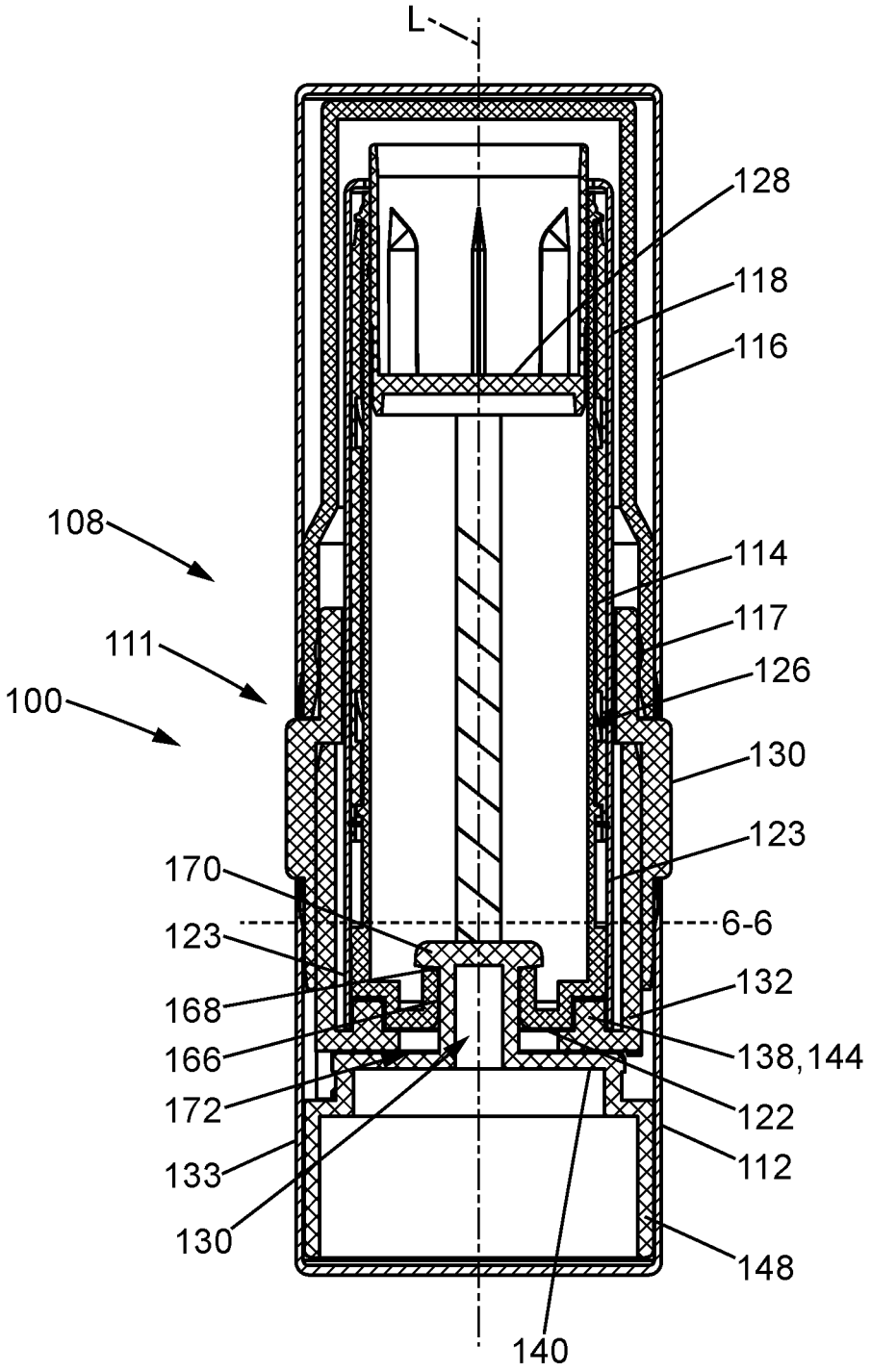
FIG. 2 shows a cross-section of a lipstick according to a first embodiment, the lipstick having inside it a removable lipstick cartridge according to one embodiment.

FIG. 2 shows a cross-section of a lipstick 108 according to a first embodiment, having a removable lipstick cartridge 114 within its interior. As explained above with reference to FIG. 1, the lipstick 108 comprises a receptacle 111 which is an outer shell of the lipstick 108. The receptacle 111 comprises a base 112 suitable for receiving the cartridge 114, and a cap 116 which cooperates with the base 112 so as to create an external protective shell around the cartridge 114. When the cap 116 is connected to the base 112, for example by a magnetic and/or mechanical device 117, the cartridge 114 is not accessible. To make it accessible, the cap 116 is disengaged from the base 112. In the example in the figures, the device 117 is mechanical and consists of studs distributed uniformly around the base 112 and which create friction with the cap 116 in order to hold it in place on the base 112 (more visible in FIG. 3).

Figure 3:
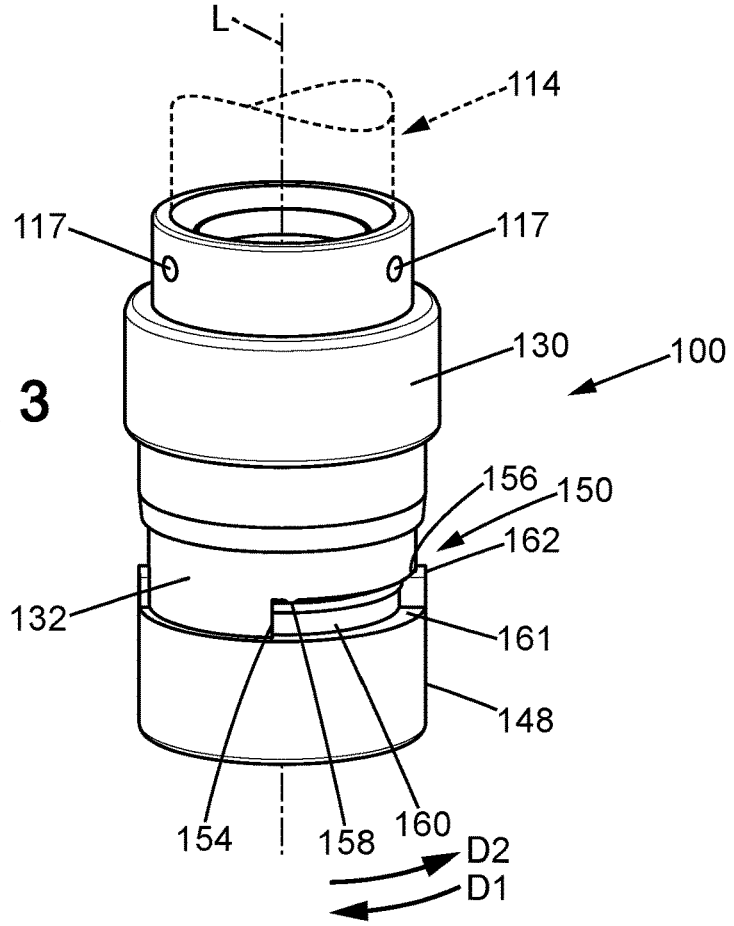
FIG. 3 shows a perspective view from above of a base according to one embodiment of the invention for the lipstick of FIG. 2, with a portion of a lipstick cartridge indicated by dotted lines and an outer shell of the base omitted in order to reveal various elements of the base.
Figure 4:
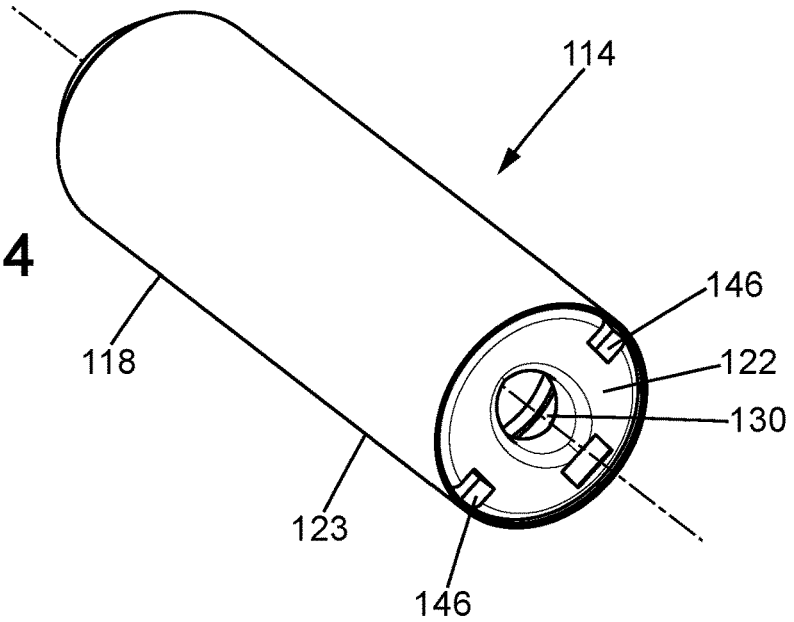
FIG. 4 shows a perspective view from below of the removable cartridge of the lipstick of FIG. 2.

Referring to FIGS. 3 and 4, the assembly 100 for dispensing comprises the base 112 of the lipstick 108 and the removable cartridge 114. The cartridge 114 has an outer sheath 118 (similar to the protective sheath 18) and a control socket 122 internal to the sheath 118 and provided in a lower portion 123 of the cartridge 114. The control socket 122 allows the extraction of cosmetic product from the cartridge 114 by activating a lipstick dispensing system 126 (visible in FIG. 2). The dispensing system 126 is a conventional system for extracting a stick of lipstick in a tube of lipstick and will not be described in detail here. The cartridge 114 has an opening 130 in the control socket 122 to allow connection with the base 112. This opening can also serve as a keying system between the base 112 and the cartridge 114, as only a base 112 adapted to engage with this opening and secure the cartridge 114 will allow the coupling between the base 112 and the cartridge 114.

The base 112 comprises a receiving element 132 for the cartridge 114 which cooperates with the cartridge 114 when the latter is arranged in the base 112, and a locking element 148 to secure the cartridge 114 in the base 112. The receiving element 132 is integral with the ring 130 (for example glued), and the locking element 148 is integral with the outer shell 133 of the base 112 (for example glued). Thus a relative rotation of the ring 130 with respect to the outer shell 133 about the longitudinal axis L creates a relative rotation between the receiving element 132 and the locking element 148 in order to secure or disengage the cartridge 114 from the base 112.

Figure 5:
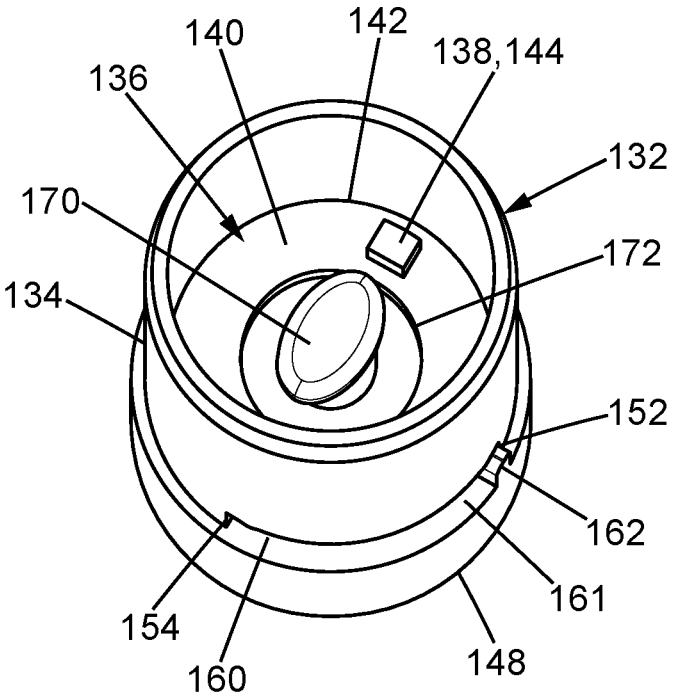
FIG. 5 shows a perspective view from above of a portion of the base of FIG. 3.

Referring now to FIG. 5, the receiving element 132 has a sleeve 134 suitable for receiving within its interior 136 the lower portion 123 of the cartridge 114. According to the embodiment of FIGS. 2 to 7, the receiving element 132 includes a bottom portion 140 which partially closes off a lower portion 142 of the sleeve 134. The bottom portion 140 could be omitted, however. The bottom portion 140 includes an opening 172.

The receiving element 132 has a transmission element 138 that can be engaged with the control socket 122 of the cartridge 114. According to the embodiment of FIGS. 2 to 7, the transmission element 138 is arranged on the bottom portion 140. However, it is possible for the transmission element 138 to be arranged elsewhere in the base 112 than on the bottom portion 140, for example such as on the sleeve 134 or on the locking element 148. According to the embodiment of FIGS. 2 to 7, the transmission element 138 comprises a plurality of lugs 144 arranged on the bottom portion 140 at an equal distance from each other. The lugs 144 can be engaged with corresponding recesses 146 of the control socket 122 of the cartridge 114. In the example of FIGS. 2 to 7, the assembly 100 comprises two lugs 144. However, it is possible for the assembly 100 to have just one or more than two lugs. The lugs may be of square, circular, or other cross-section. The lugs could alternatively be arranged on the cartridge 114, and the receiving element 132 would then have corresponding recesses. The transmission element 138 could also be a male-female system that is different than lugs-recesses.

Referring again to FIG. 3, the locking element 148 is movable relative to the receiving member 132 at least in rotation about the longitudinal axis L in a first direction D1 (or opening direction) to an open position and in a second direction D2 (or closing direction) to a closed position. According to the embodiment in the figures, the second direction D2 is in the opposite direction to the first direction D1. In the open position, the cartridge 114 is movable relative to the base 112 along the longitudinal axis L. The open position therefore makes it possible to change the cartridge 114. In the closed position when the cartridge 114 is inserted into the base 112, the cartridge 114 is integral with the base 112 along the longitudinal axis L. The closed position makes it possible to secure the cartridge 114 in the base 112, and therefore to use the lipstick.

A connection 150 between the locking element 148 and the receiving element 132 which makes it possible to change from the open position to the closed position and vice versa comprises a closure abutment 152 in the closed position such that when the locking element 148 is in the closed position and the base 112 is rotated in the closing direction D2 (i.e. in the same direction as is used to move to the closed position), the receiving element 132 and the locking element 148 are integral in rotation and the control socket 122 of the cartridge 114 is driven by the transmission element 138. The connection 150 between the locking element 148 and the receiving element 132 may also comprise an opening abutment 154 in the open position when the base 112 is rotated in the opening direction D1. The opening abutment 154 serves to indicate to the user that the locking element 148 is in the open position, and therefore that the cartridge 114 can be engaged/disengaged from the base 112.

The connection 150 between the locking element 148 and the receiving element 132 may further comprise a closure catch 156 at the closure abutment 152 (i.e. just before the closure abutment 152) so as to create resistance when the locking element 148 is in the closed position and the base 114 is rotated in the first direction D1. The connection 150 between the locking element 148 and the receiving element 132 may further comprise an opening catch 158 at the opening abutment 154 (i.e. just before the opening abutment 154) so as to create resistance when the locking element 148 is in the open position and the base 114 is rotated in the closing direction D2. The catches 156, 158 can provide resistance to unwanted locking and unlocking. The connection 150 could contain more than two catches, for example a plurality of catches, some of them of less resistance to give the sensation of various clicks when the user transitions it from the open position to the closed position and vice versa.

More specifically, the connection 150 between the locking element 148 and the receiving element 132 comprises, according to one embodiment, a slot 160, and a finger 162 engaged with and movable within the slot 160. In this embodiment of the assembly 100, the base 112 is equipped with two slots 160 each with a finger 162, the slots being arranged opposite one another. However, for simplicity, a single slot 160 and finger 162 will be described below. It is understood that the connection 150 could comprise a single slot-finger system or more than two slot-finger systems. The connection 150 could also be achieved by means other than a slot-finger system. For example, the connection 150 could be formed by a groove and a pin engaged in the groove.

The slot 160 may be located in one among the locking element 148 and the receiving element 132, and the finger 162 in the other among the locking element 148 and the receiving element 132. In the embodiment of FIGS. 2 to 7, the slot 160 is located in the receiving element 132, and the finger 162 in the locking element 148. The slot 160 has the general shape of an arc of a circle which extends in a fixed longitudinal position. The length of the slot 160 defines an amplitude of rotation between the locking element 148 and the receiving element 132. In one embodiment, the slot 160 extends over a semicircle or less of the circumference (for example a quarter of a circle or a third of a circle or six-eighths of a circle) of the receiving element 132 or locking element 148 on which it is located. Thus, according to one embodiment, the rotation between the locking element 148 and the receiving element 132 takes place over an angle that is less than or equal to 180 degrees, preferably less than 90 degrees, and even more preferably about 75 degrees about the longitudinal axis L. The angle could just as well be any angle between 180 degrees and 30 degrees, for example 40 degrees or 50 degrees.

The slot 160 may be open or closed. In the example of FIGS. 2 to 7, the slot 160 is open at one of its two long sides, the open side being closed by a rim 161 of the locking element 148.

The opening and closure abutments 152, 154 are ends of the slot 160. According to one embodiment, the distance between the catch 156 or 158 and the corresponding closest abutment 152, 154 is approximately the size of the finger 162.

Figure 6:
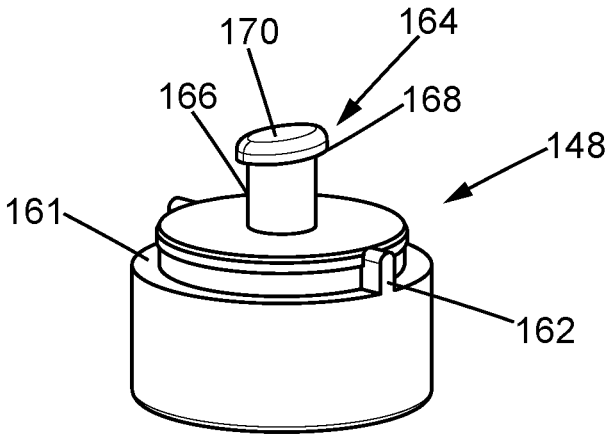
FIG. 6 shows a perspective view from above of a locking element according to one embodiment of the base of FIG. 3.
Figure 7:
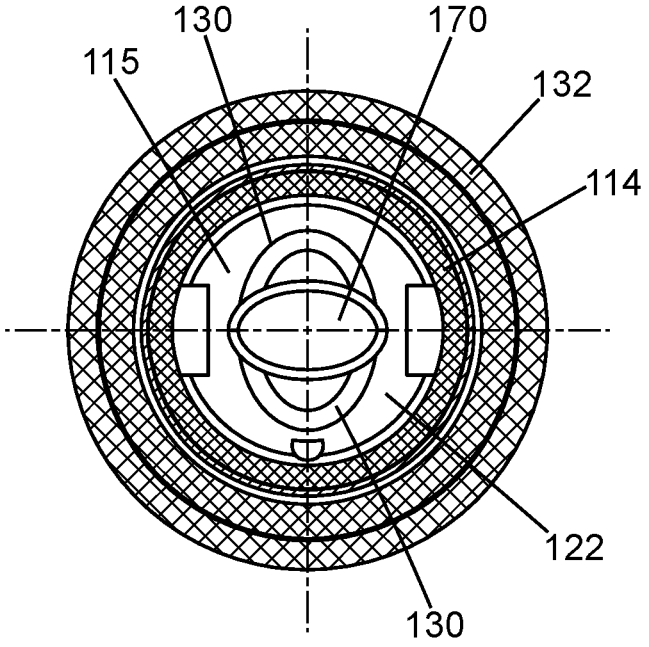
FIG. 7 shows a cross-section at line 6-6 of the lipstick of FIG. 2.
Figure 8:
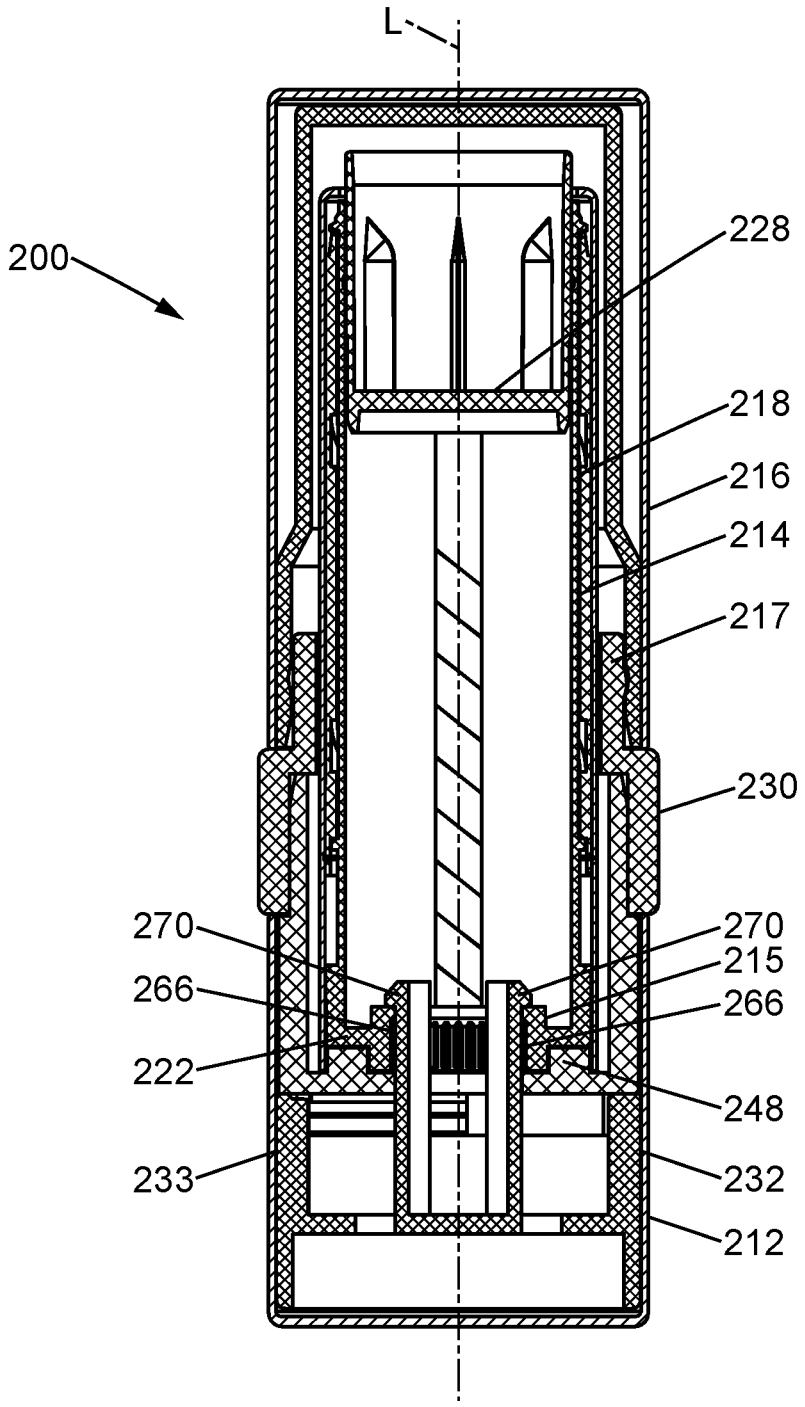
FIG. 8 shows a cross-section of a lipstick according to a second embodiment, the lipstick having inside itself a removable lipstick cartridge according to one embodiment.
Figure 9:
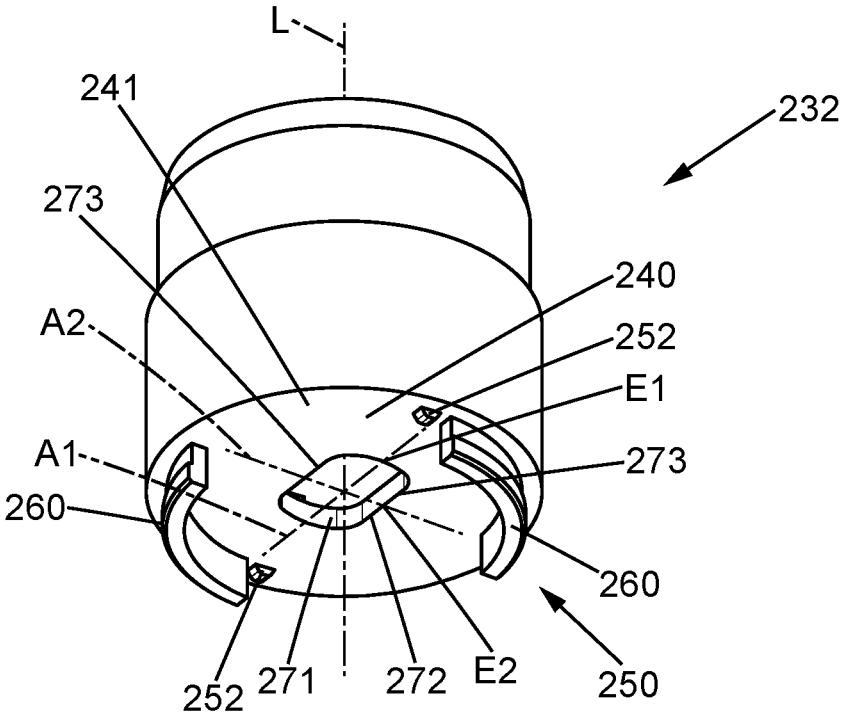
FIG. 9 shows a perspective view from below of a receiving element according to one embodiment of a base of the lipstick of FIG. 8.
Figure 10:
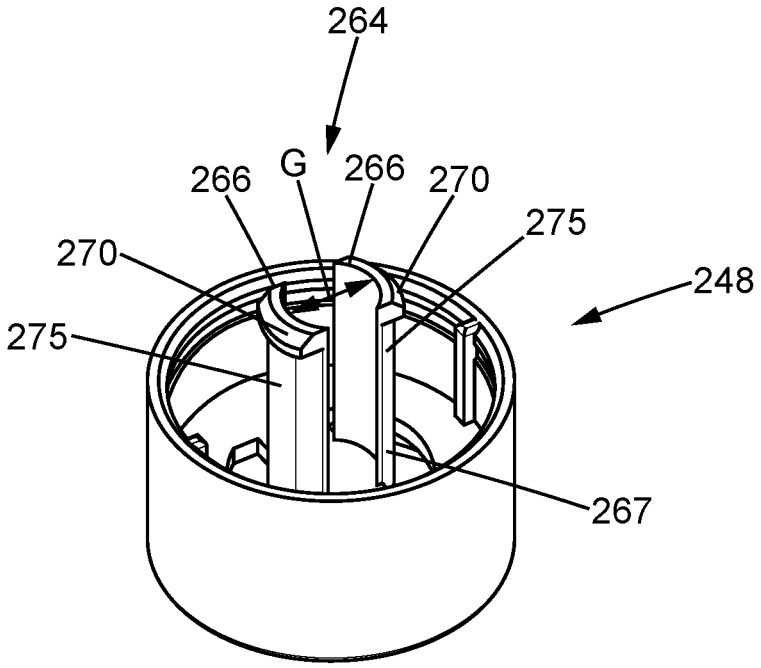
FIG. 10 shows a perspective view from above of a locking element according to one embodiment of the base of the lipstick of FIG. 8.
Figure 11:
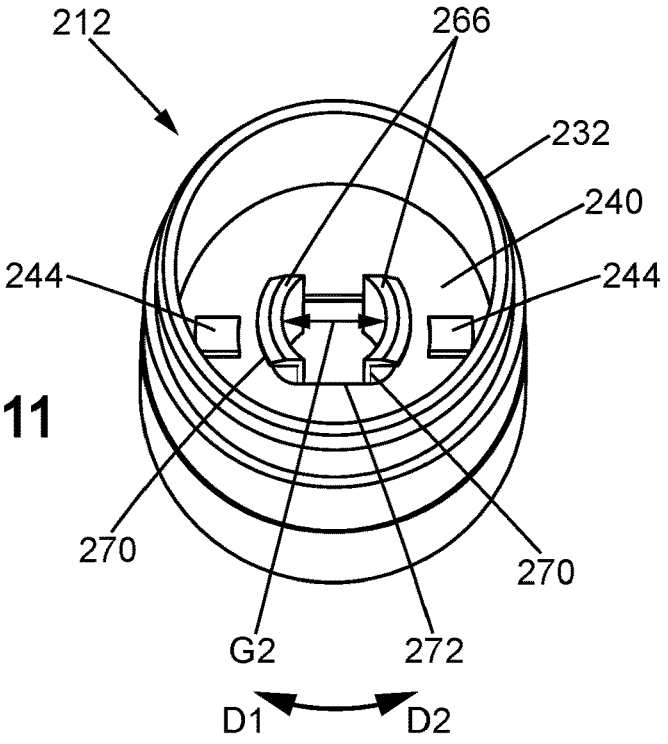
FIG. 11 shows a perspective view from above of a portion of the base according to one embodiment of the lipstick of FIG. 8, the portion of the base illustrated comprising the receiving element of FIG. 9 and the locking element of FIG. 10.
Figure 12:
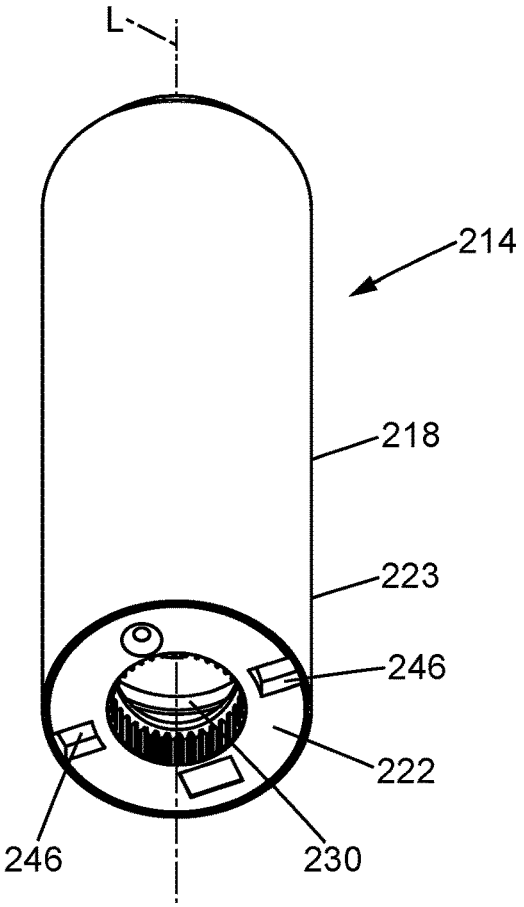
FIG. 12 shows a perspective view from below of a lipstick cartridge according to one embodiment of the lipstick of FIG. 8.
Figure 13:
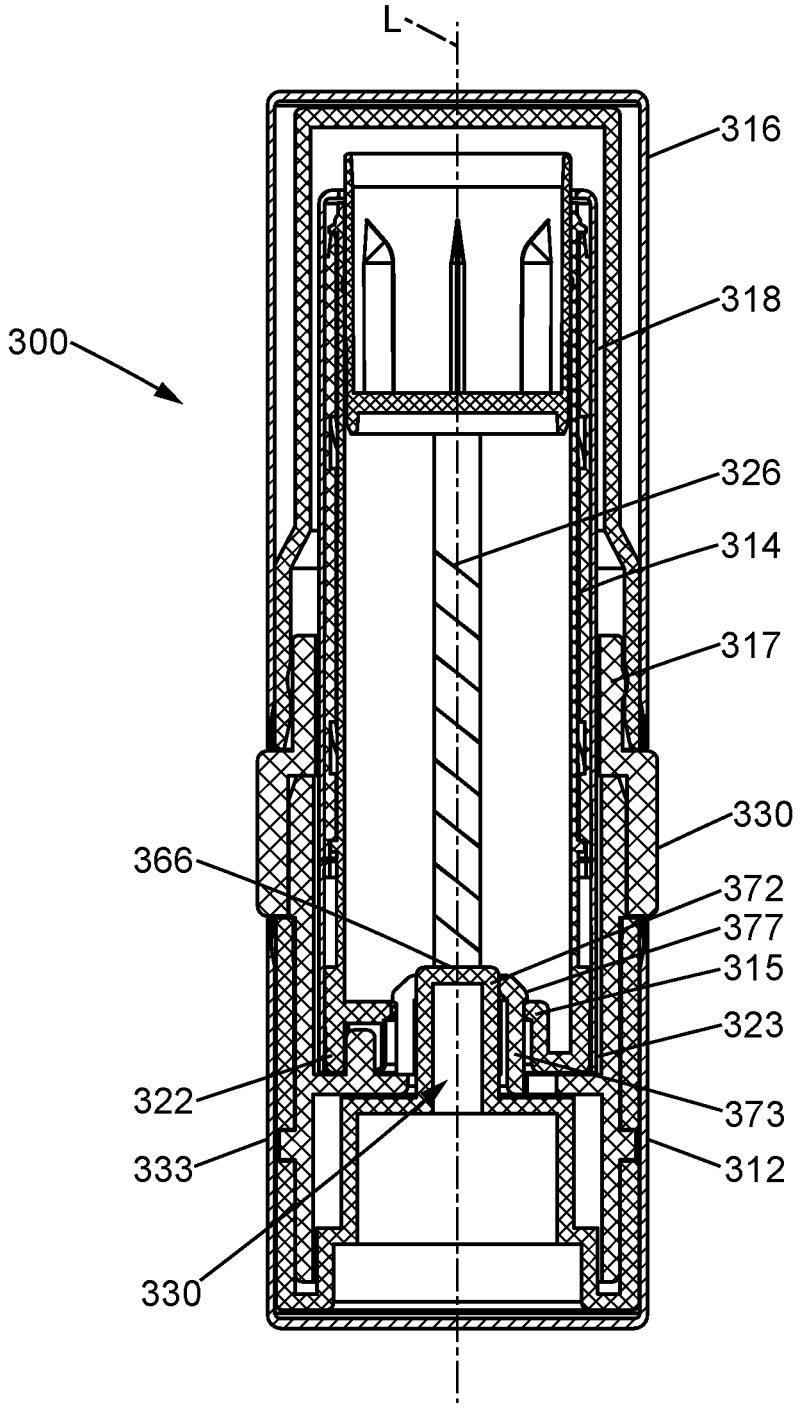
FIG. 13 shows a cross-section of a lipstick according to a third embodiment, the lipstick having inside itself a removable lipstick cartridge according to one embodiment.

Referring more particularly to FIGS. 6 and 7, the locking element 148 comprises a locking member 164 that can be engaged in the opening 130 of the cartridge 114 in order to lock the cartridge 114 to the base 112. The locking member 164 is received in the opening 172 of the bottom portion 140, and the lugs 144 are arranged on the bottom portion 140 around the locking member 164 and the opening 172, at an equal distance from each other.

According to the embodiment illustrated in FIGS. 2 to 7, the locking member 164 comprises a rod 166 having a free end 168. The free end 168 comprises a radial projection 170 that is not symmetrical in revolution (meaning not circular) relative to the longitudinal axis L, and the opening 130 of the cartridge 114 has a shape complementary to the projection 170. In the example of FIGS. 2 to 7, the projection 170 and the opening 130 have an oval shape.

When the non-symmetrical shapes are aligned (i.e. the open position), the locking member 164 can be inserted into the opening 130, and when the non-symmetrical shapes are not aligned (i.e. the closed position and as can be seen in FIG. 7), the locking member 164 can no longer be inserted into or disengaged from the opening 130. The complementarity of the shapes of the opening 130 and of the projection 170 allows a keying system between the cartridge 114 and the base 112, so that only cartridges 114 compatible with the base 112 can be inserted.

The shape of the projection 170 and of the corresponding opening 130 allows locking according to the angle of rotation defining the open and closed positions. An angle and a shape are chosen such that, in the open position, the locking member 164 is in a different position than in the closed position. In the example of FIGS. 2 to 7, the shape is oval and the angle of rotation is strictly less than 180 degrees so that the same position of the shape is not reached in the open and closed positions.

According to one embodiment, the transmission element 138 and the locking member 164 are one and the same element. To achieve this, the locking member 164 may have a portion which engages for example in a slot of the control socket 122, so that when the locking element 148 is rotated, the control socket 122 is as well. According to this embodiment, the transmission element 138 would be located on the locking element 148 and not on the receiving element 132.

According to one embodiment, the receiving 132 and locking elements 148 are each made of a single molded piece of plastic, the two being assembled by friction. However, it is possible that the receiving 132 and locking elements 148 are made of several pieces of plastic or other material.

Referring now to FIGS. 8 to 12, a second embodiment of a refillable assembly 200 for dispensing cosmetic product, in particular lipstick, is presented. Assembly 200 is similar to assembly 100 except for the connection between the receiving element and the locking element, the locking member, the opening of the bottom portion of the receiving element, and the opening in the control socket of the cartridge. Therefore, for brevity, the common elements between assembly 100 and assembly 200 will not be described again in detail in this section, and will have the same reference numbers but in the two hundreds.

The connection 250 between the receiving element 232 and the locking element 248 is made by a variant of the slot-finger system described above. However, it is conceivable that the connection 250 is provided by a slot-finger system as well. The connection 250 is formed of two elements nested together. The first element 260 is arranged on the receiving element 232 (on the face 241 of the bottom portion 240 that is opposite to the face which receives the cartridge 214) and the second element (not shown) is arranged on the locking element 248 facing the face 241 of the bottom portion 240. According to the embodiment illustrated in the figures, the first element 260 is of a generally L-shaped cross-section, and extends in the shape of an arc of a circle. The second element engages the first element 260, so that the receiving element 232 and the locking element 248 can slide in rotation relative to each other, guided by the arc of a circle formed by the first element 260.

The connection 250 is shown here as formed of two first element-second element assemblies arranged opposite each other. However, it is possible that the connection 250 has only one or more than two first element-second element assemblies.

The connection 250 further comprises a closure abutment 252. The connection could further comprise an opening abutment similar to what has been described above.

Instead of the rod 166 and the projection 170, the locking member 264 of the base 212 of the assembly 200 comprises two flexible tabs 266, each having a projection 270 at their free end 275. The tabs 266 are adapted to extend along the longitudinal axis L into the opening 230 of the cartridge 214, so that the projections 270 can engage with a corresponding rim 215 of the cartridge 214 in order to solidify the cartridge 214 to the base 212. The rim 215 is internal to the cartridge 214. It is accessible from the opening 230 in the control socket 222 of the cartridge 214. The rim 215 may be an unhindered rim or else form part of a slot. It may be a single rim or slot, or the control socket 322 may have as many rims or slots as there are flexible tabs 266. The rim 215 may be of a size and shape corresponding to the projection 270 of each flexible tab 266.

The flexible tabs 266 further extend through the opening 272 of the bottom portion 240 of the receiving element 232. The locking member 264 could have more than two flexible tabs, for example three. In the embodiment of the figures, the opening 230 is circular. However, it is conceivable for the opening 230 to have a non-circular shape, such as oval or square.

The flexible tabs 266 are in abutment at their lower end 267 against a wall 271 of the opening 272 of the bottom portion 240 of the receiving element 232. The opening 272 has a shape that is not symmetrical in revolution relative to the longitudinal axis L, such that the relative position of the flexible tabs 266 with respect to the opening 272 defines a variable distance G between the flexible tabs 266. In the open position of the locking element 248, the flexible tabs 266 are radially closer to each other than in the closed position of the locking element 248. In the open position of the locking element 248 the flexible tabs 266 are at a distance G1, and in the closed position of the locking element 248 the flexible tabs 266 are at a distance G2 greater than G1. The distance G2 is greater than the size of the opening 230 of the control socket 222, so as to ensure the coupling between the cartridge 214 and the base 212. The distance G1 is less than the size of the opening 230 of the control socket 222, so as to be able to place and remove the cartridge 214 from the base 212.

In the embodiment of FIGS. 8 to 12, the opening 272 of the bottom portion 240 of the receiving element 232 is generally oval in shape with rectilinear sides 273 and comprising a major axis A1 and a minor axis A2. In the open position, each of the flexible tabs 266 is positioned at an end E1 of the major axis A1, and in the closed position each of the flexible tabs 266 is positioned at an end E2 of the minor axis A2. Thus, when the flexible tabs 266 are in abutment against the short side A1, they are at distance G1, and when the flexible tabs 266 are in abutment against the large side A2, they are at distance G2 from one another. By moving the flexible tabs from abutment against the small side A1 to abutment against the large side A2 and vice versa, the distance G can be varied and therefore the projection 270 of the flexible tabs 266 engages or does not engage the rim 215 internal to the control socket 222 in order to secure the cartridge 214 to the base 212.

As the flexible tabs 266 are fixedly connected to the locking element 248, and the opening 272 is part of the receiving element 232, rotation of the receiving element 232 relative to the locking element 248 makes it possible to move the abutment of the flexible tabs 266 between the small side A1 and large side A2 and thus bring the flexible tabs 266 closer together or further apart to engage or not engage the internal rim 215 of the cartridge 214, using gestures similar to those explained above.

In the embodiment of FIGS. 8 to 12, the transmission element 238 (i.e. the lugs 244) for driving the rotation of the control socket 222 of the cartridge 214 are located on the bottom portion 240, aligned with the major axis A1. However, the transmission element 238 could be located elsewhere on the receiving element 232.

According to one embodiment, the transmission element 238 and the flexible tabs 266 are one and the same element. By engaging with a corresponding recess in the control socket 222, the flexible tabs 266 can act as the transmission element 238, so that when the locking element 248 is rotated, the control socket 222 is as well. According to this embodiment, the transmission element 238 would be located on the locking element 248 and not on the receiving element 232.

Referring now to FIGS. 13 to 17, a third embodiment of a refillable assembly 300 for dispensing cosmetic product, in particular lipstick, is presented. Assembly 300 is similar to assembly 100 except for the locking member, the opening of the bottom portion of the receiving member, and the opening in the control socket of the cartridge. Therefore, for brevity, the common elements between assembly 100 and assembly 300 will not be described again in detail in this section, and will have the same reference numbers but in the three hundreds.

The dispensing assembly 300 comprises a base 312 and a cartridge 314 that is selectively connectable with the base. The cartridge 314 has an outer sheath 318 (similar to the protective sheath 18) and a control socket 322 internal to the sheath 318 and arranged in a lower portion 323 of the cartridge 314. The control socket 322 allows extracting cosmetic product from the cartridge 314 by actuating a lipstick dispensing system 326. The cartridge 314 has an opening 330 in the control socket 322 to allow connection with the base 312.

The base 312 comprises a receiving element 332 for the cartridge 314. The receiving element 332 has a sleeve 334 suitable for receiving within its interior 336 the lower portion 323 of the cartridge 314. According to the embodiment of FIGS. 13 to 17, the receiving element 332 includes a bottom portion 340 which partially closes off a lower portion 342 of the sleeve 334. The bottom portion 340 could be omitted, however. The receiving element 332 has a transmission element 338 which can be engaged with the control socket 322 of the cartridge 314. According to the embodiment of FIGS. 13 to 17, the transmission element 338 is arranged on the bottom portion 340. However, it is possible for the transmission element 338 to be arranged elsewhere in the base 312 than on the bottom portion 340. According to the embodiment of FIGS. 13 to 17, the transmission element 338 comprises a plurality of lugs 344 arranged on the bottom portion 340 at an equal distance from one another. The lugs 344 are engageable with corresponding recesses (not shown) of the control socket 322 of the cartridge 314. In the example of FIGS. 13 to 17, the assembly 300 comprises three lugs 344. However, it is possible that the assembly 300 has just one, two, or more than three lugs. The lugs 344 may be of square, circular, or other cross-section. The lugs 344 could alternatively be arranged on the cartridge 314, and the receiving element 332 would then have corresponding recesses. The transmission element 338 could also be a different male-female system than lugs-recesses.

The base 312 further comprises a locking element 348 which cooperates with the cartridge 314 when the latter is arranged in the base, in order to secure the cartridge 314 in the base 312. The locking element 348 is movable relative to the receiving element 332 at least in rotation about the longitudinal axis L in a first direction D1 towards an open position and in a second direction D2 towards a closed position. According to the embodiment in the figures, the second direction D2 is in the opposite direction to the first direction D1. In the open position, the cartridge 314 is movable relative to the base 312 along the longitudinal axis L. In the closed position, when the cartridge 314 is inserted into the base 312, the cartridge 314 is integral with the base 312 along the longitudinal axis L.

A connection 350 between the locking element 348 and the receiving element 332 comprises a closure abutment 352 in the closed position such that when the locking element 348 is in the closed position and the base 312 is rotated in the second direction D2 (meaning in the same direction as that used to change to the closed position), the receiving element 332 and the locking element 348 are integral in rotation and the control socket 322 of the cartridge 314 is driven by the transmission element 338. The connection 350 between the locking element 348 and the receiving element 332 may comprise an opening abutment 354 in the open position when the base 312 is rotated in the opening direction D1. The opening abutment makes it possible to indicate to the user that the locking element 348 is in the open position. The connection 350 between the locking element 348 and the receiving element 332 may further comprise a closure catch 356 at the closure abutment 352 (i.e. just before the closure abutment 352) so as to create resistance when the locking element 348 is in the closed position and the base 314 is rotated in the opening direction D1. The connection 350 between the locking element 348 and the receiving element 332 may further comprise an opening catch 358 at the opening abutment 354 (i.e. just before the opening abutment 354) so as to create resistance when the locking element 348 is in the open position and the base 314 is rotated in the second direction D2. The catches 356, 358 can offer resistance to unwanted locking and unlocking. The connection 350 could contain more than two catches, for example a plurality of catches, some of them of less resistance to give the sensation of various clicks when the user moves from the open position to the closed position and vice versa.

More specifically, the connection 350 between the locking element 348 and the receiving element 332 comprises a slot 360 and a finger 362 engaged with and movable within the slot 360. In this embodiment of the assembly 300, the base 312 is equipped with two slots 360 each with a finger 362, the slots being arranged opposite one another. For simplicity, a single slot 360 and finger 362 will be described. It is understood that the connection 350 could comprise only one slot-finger system or more than two slot-finger systems. The connection 350 could also be made by means other than a slot-finger system. For example, the connection 350 could be formed by a groove and a pin engaged in the groove, or by a system of grooves or snap-fitting grooves (elastic interlocking) as presented above.

Figure 14:
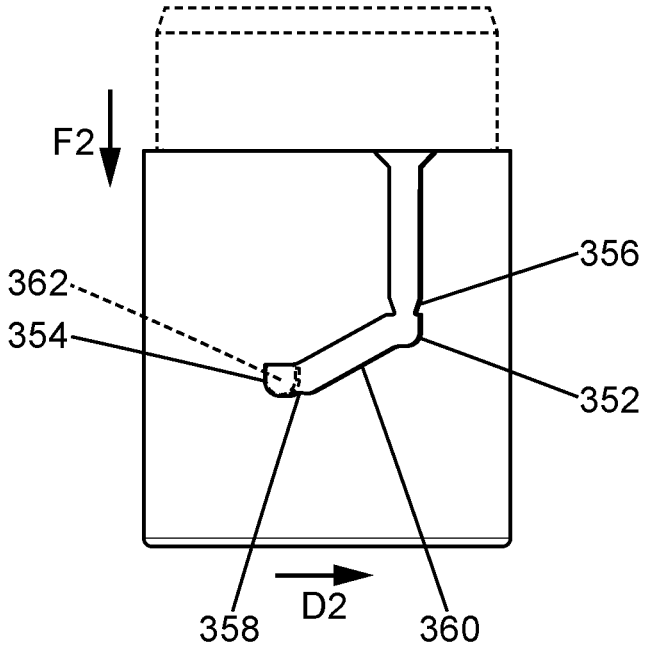
FIG. 14 shows a side view of a lipstick base of FIG. 13 comprising a locking element and a receiving element, the view being when the locking element of the base is in a closed position.
Figure 15:
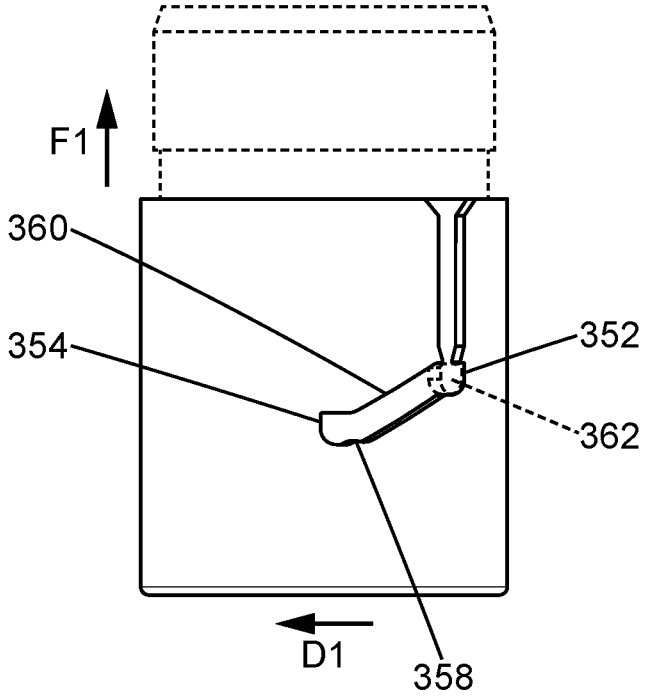
FIG. 15 shows a side view of the lipstick base of FIG. 13 when the locking element is in an open position.

Referring more particularly to FIGS. 14 and 15, the slot 360 may be located in one among the locking element 348 and the receiving element 332, and the finger 362 in the other among the locking element 348 and receiving element 332. In the embodiment of FIGS. 13 to 17, the slot 360 is in the receiving element 332, and the finger 362 in the locking element 348. The slot 360 has the general shape of an arc of a circle which extends in a variable longitudinal position such that, when the locking element 348 is moved relative to the receiving element 332 in the first D1 or the second D2 direction, the locking element 348 follows a helical motion. The helical motion enables the user to know instinctively in which position (open or closed) the locking element 348 is located. For example, when the helical motion is performed in the opening direction D1, and the helical motion is tending to move the receiving element 332 away from the locking element 348 (arrow F1 in FIG. 15), an intuitive feeling that the rotation is towards the position of releasing the cartridge 314 from the base 312 is obtained. Similarly, when the helical motion is performed in the closing direction D2, and the helical motion is tending to move the receiving element 332 closer to the locking element 348 (arrow F2 in FIG. 14), an intuitive feeling that the rotation is towards the position of securing the cartridge 314 in the base 312 is obtained.

The length of the slot 360 defines an amplitude of rotation between the locking element 348 and the receiving element 332. According to one embodiment, the slot 360 extends over a semicircle or less of the circumference (for example a quarter of a circle or a third of a circle) of the receiving element 332 or of the locking element 348 on which it is located. Thus, according to one embodiment, the rotation between the locking element 348 and the receiving element 332 takes place over an angle of less than 180 degrees, preferably less than 90 degrees, and even more preferably about 75 degrees about the longitudinal axis L. The angle could just as well be any angle between 180 degrees and 30 degrees, for example 40 degrees or 50 degrees.

The slot 360 is closed along its two long sides.

The opening and closure abutments 352, 354 are ends of the slot 360. According to one embodiment, the distance between the catch 356 or 358 and the closest corresponding abutment 352, 354 is substantially the size of the finger 362.

Figure 16:
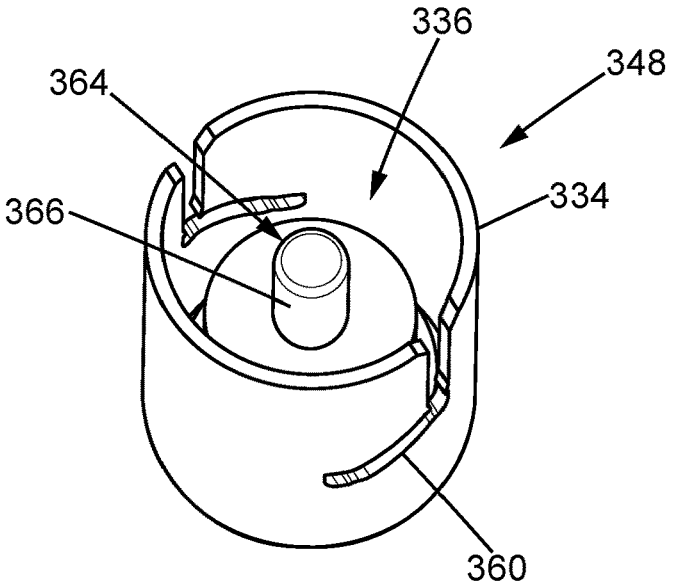
FIG. 16 shows a perspective view from above of the locking element of the lipstick base of FIG. 13.
Figure 17:
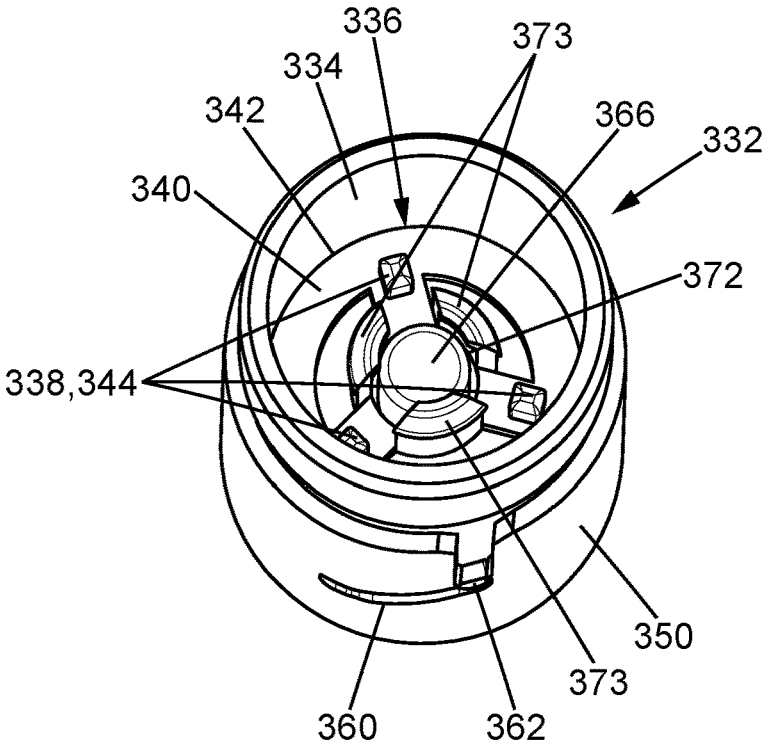
FIG. 17 shows a perspective view from above of a portion of the lipstick base of FIG. 13, the portion illustrated comprising the locking element and the receiving element of the base.

Referring to FIGS. 16 and 17, the locking element 348 comprises a locking member 364 which assists in engaging a plurality of flexible tabs of the receiving element 332 in the opening 330 of the cartridge 314 in order to lock the cartridge 314 to the base 312. According to one embodiment, the locking member 364 comprises a stud 366 extending along the longitudinal axis L through an opening 372 of the bottom portion 340 of the receiving element 332.

The plurality of flexible tabs 373 are arranged around and in contact with the stud 366 so as to define the opening 372 through which the stud 366 extends. A connection 350 between the locking element 348 and the receiving element 332 is such that the rotation between the locking element 348 and the receiving element 332 causes movement of the stud 366 along the longitudinal axis L (following the helical motion). The movement of the stud 366 along the longitudinal axis L influences the distance of the plurality of flexible tabs 373 (the advancing stud 366 tending to push them outwards, and vice versa) relative to one another between the open position and the closed position.

The flexible tabs 373 comprise a projection 377 at their free end, which, when the cartridge 314 is arranged in the receiving element 312, can engage a rim 315 of the cartridge 314 accessible from the opening 330 in the control socket. The action of engaging the projections 377 with the rim 315 secures the cartridge 314 to the base 312. The rim 315 may be an unhindered rim or may be part of a slot. It may be a single rim or slot, or the control socket 322 may have as many rims or slots as there are flexible tabs 373.

According to one embodiment, each of the receiving 332 and locking elements 348 is made of a single molded piece of plastic, the two being assembled by friction. However, it is possible that the receiving 332 and locking elements 348 are made of several pieces of plastic or other material.

In all of the embodiments described above, although a lipstick dispensing assembly is described, it can be adapted to any type of cosmetic product, whether liquid (e.g. perfume), paste (for example eyeliner), or solid (for example blush stick).

The invention claimed is:

1. A refillable assembly for dispensing cosmetic product defining a longitudinal axis, the assembly comprising:

a base, and a cartridge selectively connectable with the base, the cartridge having an outer sheath and a control socket internal to the outer sheath and arranged in a lower portion of the cartridge, the control socket allowing the extraction of cosmetic product from the cartridge, the cartridge having an opening in the control socket, the base comprising:

a cartridge receiving element, the receiving element having a sleeve suitable for receiving within the sleeve's interior the lower portion of the cartridge, the sleeve having an interior; and a cartridge locking element, the locking element being movable relative to the receiving element at least in rotation about the longitudinal axis in a first direction towards an open position and in a second direction towards a closed position; in the open position the cartridge is movable relative to the base along the longitudinal axis, in the closed position when the cartridge is inserted into the base the cartridge is integral with the base along the longitudinal axis, a connection between the locking element and the receiving element comprising a closure abutment in the closed position such that when the locking element is in the closed position and the base is rotated in the second direction, the receiving element and the locking element are integral in rotation and the control socket of the cartridge is driven by a transmission element of the base that is engageable with the control socket of the cartridge.

2. The refillable assembly for lipstick according to claim 1, wherein the transmission element is arranged in the receiving element.

3. The refillable assembly for lipstick according to claim 2, wherein the receiving element includes a bottom portion with an opening, wherein the locking member comprises a rod extending into the opening of the cartridge through the opening of the bottom portion of the receiving element, the rod having a free end, the free end comprising a radial projection which is not symmetrical in revolution relative to the longitudinal axis, and the opening of the cartridge has a shape complementary to the projection.

4. The refillable assembly for lipstick according to claim 3, wherein the projection and the opening of the cartridge each have an oval shape.

5. The refillable assembly for lipstick according to claim 1, wherein the base comprises a locking member which is engageable in the control socket of the cartridge according to the position of the locking element.

6. The refillable assembly for lipstick according to claim 5, wherein the locking member is arranged on a bottom portion of the receiving element, the bottom portion partially closing off a lower portion of the sleeve, wherein the transmission element includes a plurality of lugs arranged on the bottom portion around the locking member at an equal distance from each other, the lugs being engageable with corresponding recesses of the control socket of the cartridge.

7. The refillable assembly for lipstick according to claim 5, wherein the locking member comprises two flexible tabs extending along the longitudinal axis into the opening of the cartridge through the opening of the bottom portion of the receiving element, said at least two flexible tabs being in abutment against a wall of the opening of the bottom portion, and the opening of the bottom portion having a shape which is not symmetrical in revolution relative to the longitudinal axis such that the relative position of the flexible tabs with respect to the opening defines a variable distance between the flexible tabs, in the open position of the locking element the two flexible tabs being radially closer to each other than in the closed position of the locking element.

8. The refillable assembly for lipstick according to claim 7, wherein the opening of the bottom portion of the receiving element is generally oval in shape, comprising a major axis and a minor axis; in the open position each of the two flexible tabs is positioned at an end of the major axis and in the closed position each of the two flexible tabs is positioned at an end of the minor axis.

9. The refillable assembly for lipstick according to claim 7, wherein each of the two flexible tabs comprises a projection capable of engaging with a corresponding rim of the cartridge.

10. The refillable assembly for lipstick according to claim 5, wherein the locking member comprises a stud extending along the longitudinal axis through the opening of the bottom portion of the receiving element, the receiving element comprises a plurality of flexible tabs extending along the longitudinal axis into the opening of the cartridge, the plurality of flexible tabs being arranged around and in contact with the stud so as to define the opening through which the stud extends, a connection between the locking element and the receiving element being such that the rotation between the locking element and the receiving element causes movement of the stud along the longitudinal axis, the movement of the stud along the longitudinal axis effecting an increasing distance of the plurality of flexible tabs relative to each other between the open position and the closed position.

11. The refillable assembly for lipstick according to claim 5, wherein the locking member is in the locking element, the receiving element includes a bottom portion in contact with the locking element which partially closes off a lower portion of the sleeve, the bottom portion having an opening, the opening receiving the locking member.

12. The refillable assembly for lipstick according to claim 5, wherein the locking member is arranged on a bottom portion of the receiving element, the bottom portion partially closing off a lower portion of the sleeve.

13. The refillable assembly for lipstick according to claim 1, wherein the connection between the locking element and the receiving element comprises an opening abutment in the open position when the base is rotated in the first direction.

14. The refillable assembly for lipstick according to claim 1, wherein the connection between the locking element and the receiving element further comprises a closure catch at the closure abutment so as to create resistance when the locking element is in the closed position and the base is rotated in the first direction.

15. The refillable assembly for lipstick according to claim 1, wherein the connection between the locking element and the receiving element comprises a slot in one among the locking element and the receiving element, and a finger in the other among the locking element and the receiving element, the finger being engaged with and movable within the slot.

16. The refillable assembly for lipstick according to claim 15, wherein the slot has a shape of an arc of a circle which extends in a fixed longitudinal position.

17. The refillable assembly for lipstick according to claim 15, wherein the slot has a shape of an arc of a circle which extends in a variable longitudinal position such that, when the locking element is moved relative to the receiving element in the first or second direction, the locking element follows a helical motion.

18. The refillable assembly for lipstick according to claim 1, wherein the rotation between the locking element and the receiving element occurs over an angle of less than 180 degrees around the longitudinal axis.

19. The refillable assembly for lipstick according to claim 1, wherein the rotation between the locking element and the receiving element occurs over an angle of less than 90 degrees around the longitudinal axis.

20. A refillable base for lipstick suitable for being associated with a removable cartridge for lipstick, the base defining a longitudinal axis, the base comprising:

a cartridge receiving element, the receiving element having a sleeve suitable for receiving within a sleeve's interior a lower portion of the cartridge, the base having a transmission element suitable for engaging with a control socket of the cartridge; and a locking element for locking the cartridge in the base, the locking element being movable at least in rotation with respect to the receiving element about the longitudinal axis, in a first direction towards an open position where the cartridge is detachable from the base along the longitudinal axis, and in a second direction towards a closed position where the cartridge is integral with the base along the longitudinal axis, a connection between the locking element and the receiving element comprising a closure abutment suitable for driving the control socket of the cartridge when the locking element is in the closed position and the base is rotated in the second direction.

* * * * *